United States Patent [19]

Grégoire

[11] Patent Number: 4,898,313

[45] Date of Patent: Feb. 6, 1990

[54] TRANSPORT DEVICE FOR TRANSPORTING OBJECTS IN THE FORM OF STRIP SEGMENTS

[75] Inventor: Jean-Pierre Grégoire, Bagneux, France

[73] Assignee: SMH Alcatel, Paris, France

[21] Appl. No.: 197,876

[22] Filed: May 24, 1988

[30] Foreign Application Priority Data

May 25, 1987 [FR] France ..... 87 07318

[51] Int. Cl.[4] ..... B65H 23/32

[52] U.S. Cl. ..... 226/197; 242/76

[58] Field of Search ..... 226/196, 197, 199; 242/76; 271/268, 271; 355/3 R, 16, 26

[56] References Cited

U.S. PATENT DOCUMENTS

| | | | |
|---|---|---|---|
| 3,548,783 | 12/1970 | Knapp | 118/224 |
| 3,707,254 | 12/1972 | Scott | 226/197 X |
| 4,265,176 | 5/1981 | Sato | 226/196 X |
| 4,266,762 | 5/1981 | Kramer et al. | 271/225 |
| 4,468,114 | 8/1984 | Pels et al. | 355/26 X |
| 4,637,566 | 1/1987 | Kyytsönen | 242/76 X |

FOREIGN PATENT DOCUMENTS

| | | |
|---|---|---|
| 1445175 | 5/1966 | France . |
| 2581029 | 10/1986 | France . |

*Primary Examiner*—David Werner
*Assistant Examiner*—Phillip Han
*Attorney, Agent, or Firm*—Sughrue, Mion, Zinn, Macpeak & Seas

[57] ABSTRACT

A transport device for transporting objects in the form of strip segments while causing them to rotate through up to at least 90° about the axis along which said objects are being transported. The device comprises two walls (50) disposed parallel to each other, with means (51) for holding these walls spaced apart from each other in such a manner as to allow the objects to be transported to pass therebetween, and in that said walls are twisted together about their longitudinal axis so that the slot between them at one of their ends (52) is oriented in a direction of up to at least 90° relative to the direction of the slot (53) at their other end.

4 Claims, 3 Drawing Sheets

TRANSPORT DEVICE FOR TRANSPORTING OBJECTS IN THE FORM OF STRIP SEGMENTS

The present invention relates to a transport device for transporting objects in the form of strip segments by rotating them through up to at least 90° about an axis parallel to the direction in which said flat objects are being transported. It is applicable, in particular, to franking machines for the connection between the label dispenser and a print head.

BACKGROUND OF THE INVENTION

French patent application number 85 06266 filed April 24, 1985 (equivalent to U.S. Ser. No. 855 258) in the name of the present Assignee describes a franking machine, and more particularly a label dispenser which provides labels of at least two different lengths from a continuous strip, including short labels for receiving a franking print only and long labels on which a slogan may be added. These labels are conveyed to a print head via a guide path fitted with drive wheels.

As can easily be seen from FIG. 2 of said application, the axis of the reel of tape from which the labels are taken and the axes of the rotary cylinders of the print head are mutually parallel. Since the print head is a machine for standing on a work surface with the axis of the print drum being horizontal, it follows that the reel of tape must also have a horizontal axis and that the label dispenser, which is mainly occupied by the reel of tape, is a flat apparatus standing on edge.

This disposition of the component parts of the franking machine suffers from the drawbacks that the label dispenser occupies too much room vertically and that the reel of tape is awkward to replace.

The invention thus seeks to dispose the label dispenser flat relative to the work surface with the print head remaining in the above-described position. Since the label outlet from the label dispenser is no longer parallel to the label inlet to the print head, but is rotated through 90° relative thereto, the invention therefore provides a device for connecting said outlet to said inlet while causing the labels to rotate through 90° about their longitudinal axes.

Naturally, this device providing transport with axial rotation through 90° is not limited to the above-described application. It may be employed generally on any occasion when there is a need to transport objects which are in the form of segments of strip while requiring them to rotate axially through 90°. In addition, the device of the invention is equally applicable to providing axial rotations other than through 90°.

SUMMARY OF THE INVENTION

The transport device for providing transport with axial rotation through up to at least 90° according to the invention comprises two walls disposed parallel to each other, with means for holding these walls spaced apart from each other in such a manner as to allow the objects to be transported to pass therebetween, said walls being twisted together about their longitudinal axis so that the slot between them at one of their ends is oriented in a direction of up to at least 90° relative to the direction of the slot at their other end.

Advantageously, each of these walls comprises, between one of its ends and its other end, successive juxtaposed portions having the following shapes respectively:

a first rectangular trapezium;
a first end parallelogram;
a first common trapezium;
a middle parallelogram;
a second common trapezium;
a second end parallelogram; and
a second rectangular trapezium;

with the desired twist being obtained with the trapeziums being flat, with the end parallelograms being curved as portions of cylindrical surfaces and in the same direction about the original plane surface, and with the central parallelogram being curved in the opposite direction, also to form a portion of a cylindrical surface.

By acting on the angles of the trapeziums and on the curvatures of the parallelograms, it is easy to obtain experimentally a solution to any pracitcal problem. However, walls made up from elements having geometrical shapes provide considerable practical advantages regardless of whether they are obtained by forming a thin sheet (well-defined folds only), or by molding (ease of mold provision).

Further, the walls may include openings in order to save weight and reduce friction, which openings are also useful in the event of a jam for facilitating unjamming. The sides of these openings which are encountered second by the transported objects are advantageously concave in order to reduce the risk of catching. Openings may also be provided for passing drive wheels.

BRIEF DESCRIPTION OF THE DRAWINGS

An embodiment of the invention is described by way of example with reference to the accompanying drawings, in which.

MORE DETAILED DESCRIPTION

Figure 1:
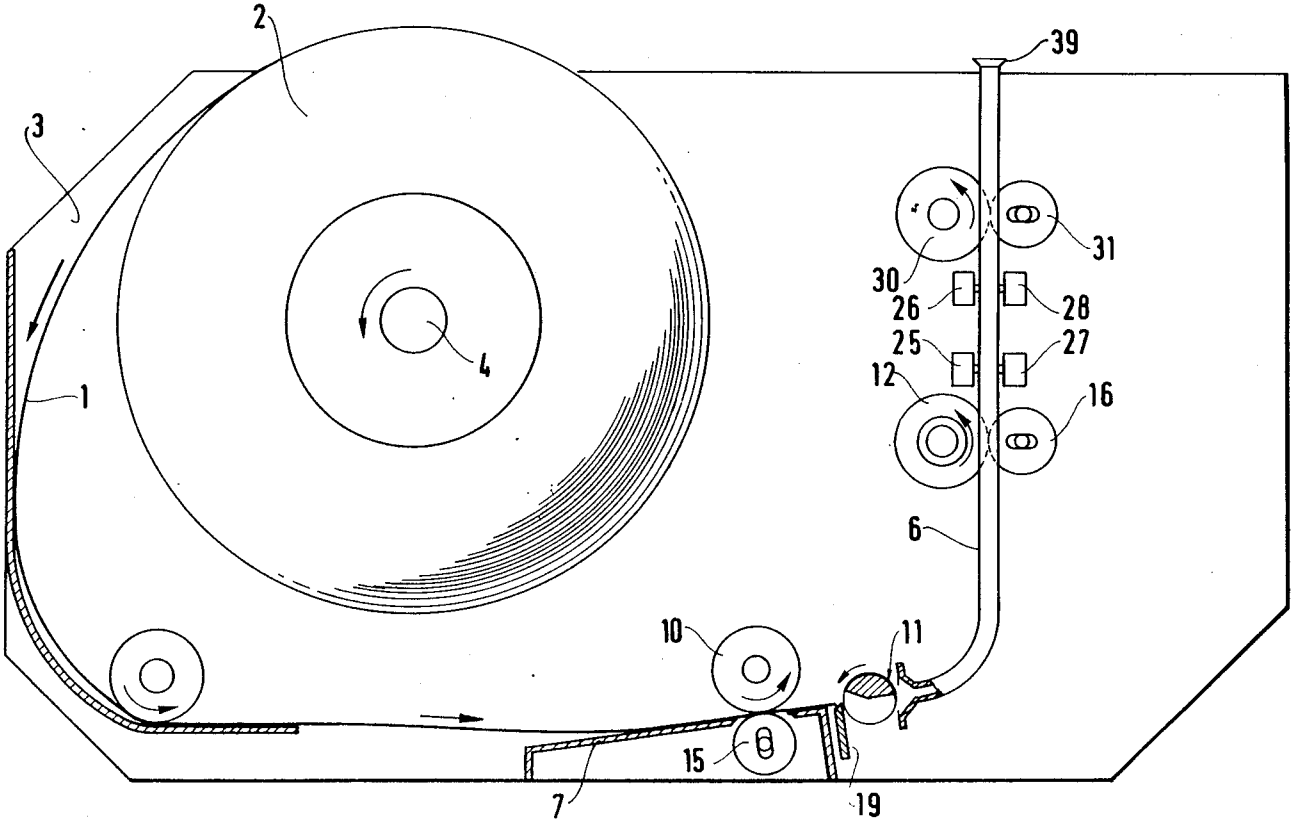
FIG. 1 is a diagrammatic plan view of a prior art label dispenser to which the invention may be applied.

A dispenser for dispensing two different lengths of label is initially described in outline with reference to FIG. 1, said dispenser being advantageously usable with a transport device of the present invention. This dispenser is the same as that described in French patent application number 85 06266 to which reference may be made for a more complete description.

The dispenser provides labels from a tape 1 taken from a reel 2 mounted on a plate 3 provided with a shaft 4. After passing over guide walls and a return wheel the tape arrives at a pair of drive wheels 10 and 15 which feed tape to a ticket separator device comprising a rotary cutter 11 operating in conjunction with a fixed blade 19 disposed at the inlet to a guide path 6. A pair of drive wheels 12, 16, a pair of extractor wheels 30, 31 and photoelectric detectors 25–27 and 26–28 are disposed along said guide path 6.

The arrival of as yet uncut tape 1 between a light source and detector pair 25 & 27 or 26 & 28 causes the cutter 11 to rotate, thereby cutting the tape under the control of control means (not shown), thereby supplying a long label or a short label as required. The drive wheels 12, 16 drive the label up to the extraction wheel 30, 31 which then send it towards the outlet 39 of the dispenser.

The above-described dispenser is shown in plan view showing the position it occupies on a work surface when the transport device of the invention is used on conjunction therewith. The plate 3 is horizontal and the shaft 4 is consequently vertical. Under these conditions, the reel 2 is easily replaced since the new reel merely needs placing on the shaft 4 and the tape guide path 1 is easily accessible. However, it should be observed that the labels are presented edge-on at the outlet 39, i.e. vertically.

Figure 2:
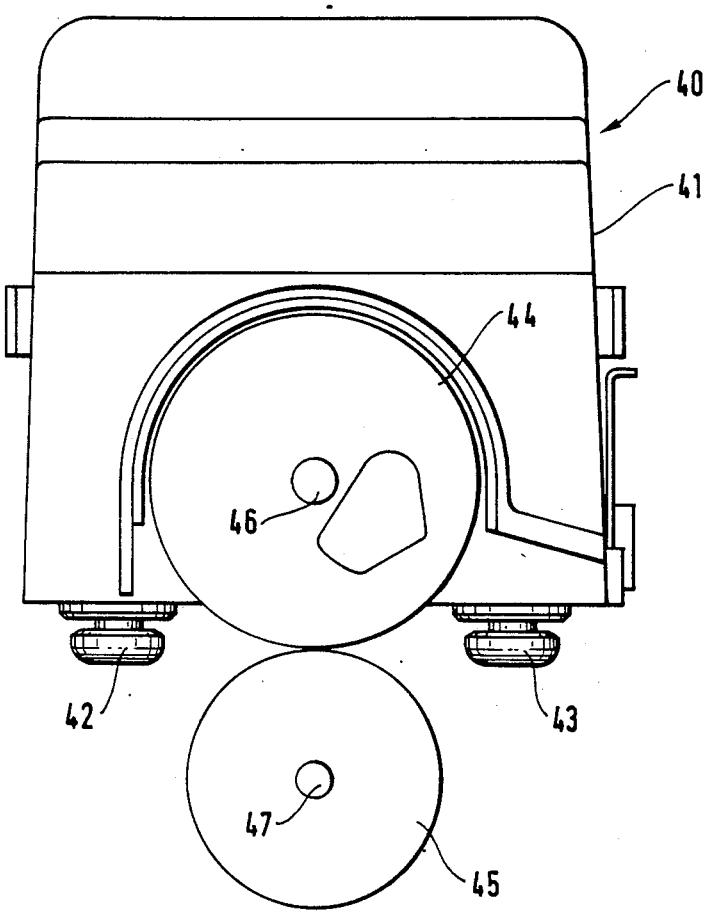
FIG. 2 is a diagrammatic elevation view of a prior art franking head to which the invention may be applied.

A franking head of known type, such as a "FRIDEN" model 9258 machine is shown, likewise diagrammatically, in FIG. 2. The only parts of this machine 40 which are shown are its housing 41, its feet 42 and 43, its print drum 44, and its print backing roll 45, together with their respective shafts 46 and 47.

Labels passing between the drum and the backing roll are printed and are transmitted to an outlet so that they can be used.

As it can be seen, since the machine stands on feet on a horizontal table, with the shafts 46 and 47 running horizontally, the labels must be presented horizontally between the drum and the backing roll.

A transport device in accordance with the invention is now described with reference to FIGS. 3, 4, and 5. The device is intended to convey objects in the form of segments of strip, such as franking labels, while causing them to rotate about their axes through up to 90°, thereby being capable of conveying labels supplied vertically by the FIG. 1 dispenser and presenting them horizontally between the drum 44 and the roll 45 of the FIG. 2 franking head.

This device is in the form of two guide walls which cannot be identical but which are of the same length and which hve geometrically similar profiles determining a gap therebetween of constant width equal to about one millimeter. Only one of these walls is shown in elevation view in FIG. 3, in plan view in FIG. 4, and developed in FIG. 5. This wall 50 is made of flat material, in the form of an elongate rectangle, whose width is not less than the width of the labels issued by the FIG. 1 dispenser, said wall further including four fixing lugs 51, and having two openings 54 and 55 formed therein.

The transport device of the invention is constituted by two such walls which are assembled by screws or rivets passing through the lugs 51 together with spacing washers of appropriate thickness in order to leave room for the thickness of the labels. The inlet to the device is referenced 52 and its outlet is referenced 53.

The openings 54 in the two assembled guide walls may be used, inter alia, for passing drive wheels such as the wheels 30, 31 of the FIG. 1 dispenser. The openings 55 may be used for the same purpose. Such openings may also provide access to the label guide path of the transport device in the event of a jam so as to make it possible to extract any labels which may have accumulated therein. The two walls may be easily separable, for the same purpose. It may be observed that the edge of each opening encountered second by a label when travelling in its displacement direction through the transport device of the invention is generally concave in shape, in the form of a roof with rounded corners, for example, thereby making it easier for the leading edges of said labels to pass said second sides since they engage them only progressively. For the same reasons, said sides could also be oblique.

Figure 3:
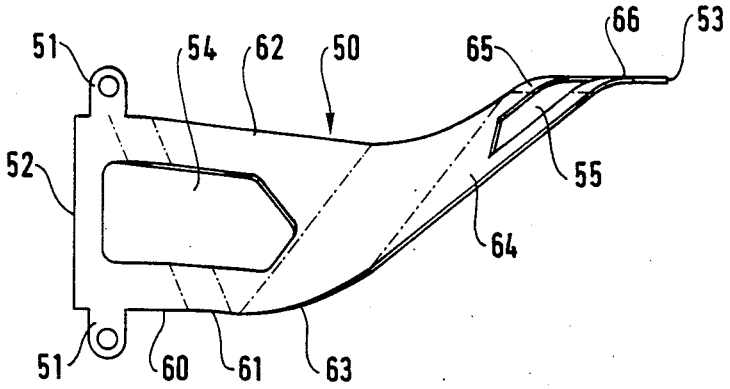
FIGS. 3 to 5 are respectively an elevation view, a plan view, and a developed view of one of two similar parts constituting the transport device of the present invention.
Figure 4:
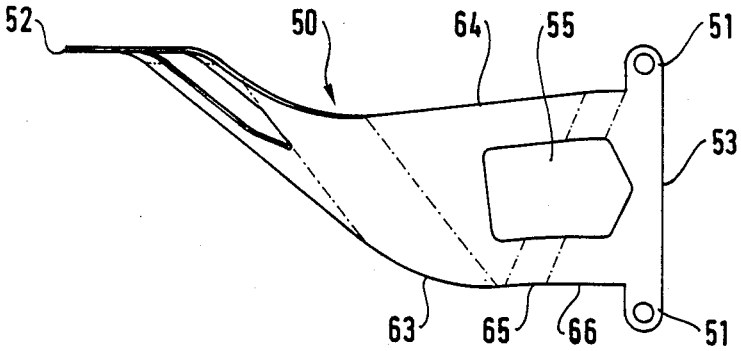
Figure 5:
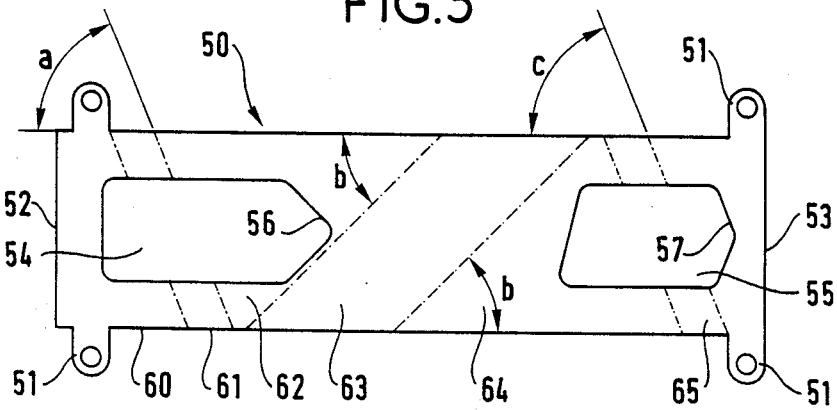

The guide wall 50 shown in FIGS. 3 and 4 is twisted in such a manner that with one of its ends (52 in FIG. 3 or 53 in FIG. 4) lying in the plane of the drawing, its other end (53 in FIG. 3, or 52 in FIG. 4) is perpendicular. By experimentally determining suitable curvature, it is possible to ensure that a label inserted in the transport device via its inlet 52 and centered transversely relative to the side edges of the device, under the thrust of the wheels 30, 31 of the FIG. 1 dispenser, for example, progresses along the device while bending suitably, and while remaining centered relative to the side edges of the device until it leaves at 53, still transversely centered. To do this, account should be taken of the stiffness of the paper from which the label is made, of its inertia, and also of friction.

The invention also proposes a transport device in which the guide walls are twisted under geometrically defined conditions, thereby greatly facilitating production of the walls, either by folding a flat plate (with the locations and conditions of folding being defined) or by molding (thereby facilitating mold manufacture). Reference is made initially to FIG. 5 which shows the guide wall 50 developed into a plane. Dot-dashed lines define the following successive juxtaposed surfaces between the inlet 52 and the outlet 53:

a first rectangular trapezium 60 whose side perpendicular to the parallel sides of the device 50 corresponds to the inlet 52 and whose sloping side is at an angle a relative to said sides;

a first end parallelogram 61;

a first common trapezium 62, one of which bases is short in length, and indeed is as short as possible after taking account of considerations bearing on the stiffness of labels paper, with the second sloping side of this trapezium extending at an angle b with the edges of the device 50;

a middle parallelogram 63;

a second common trapezium 64 equal to the first but the opposite way round thereto;

a second end parallelogram 65; and a second rectangular trapezium 66 equal to the first but the opposite way round relative thereto.

When shaping the wall 50 in order to obtain the twisted shape shown in FIGS. 3 and 4, the trapezium-shaped portions remain flat, and only the parallelogram-shaped portions are curved to take up cylindrical shapes about respective axes which are equidistant from their sides which slope relative to the edges of the device. More precisely, the end parallelograms are both curved in the same direction, whereas the inside parallelogram is curved in the opposite direction. The arc covered by each of the cylindrical portions may be determined experimentally. A practical way of doing this is to make use of computer-aided design (CAD). The axial extent of the parallelograms is selected as a function of the arcs of the cylindrical portions while taking account of the stiffness of label paper: the larger the arc and the stiffer the paper, the larger the parallelogram.

The values of the angles a, b, and c stem from the same type of consideration. It has been shown that the following values can be used to achieve an axial rotation of 90° between the input 52 and the output 53 under conditions compatible with the labels used in France by the Postal Authorities and over a total length of about 10 centimeters. The angles are measured relative to the neutral fiber of the assembly: two arcs of 138° and radius 10.75 cm for the end parallelograms, one arc of 90° and radius 10.75 cm for the middle parallelogram, and a=c=67°30", b=45°, with the angles a and b being folded towards each other in the trapezium 62 and with the angles b and c being folded towards each other in the trapezium 64.

Although not shown in the figures, the inlet 52 and the outlet 53 may both be flared, as is conventional with this type of device. The means for fixing the transport device of the invention between the FIG. 1 dispenser and the FIG. 2 franking head are not shown in the figures. The lugs 51 may be used for this purpose. In any event, such means are within the competence of a technician in this field.

The embodiment described above relates to conveying labels from a label dispenser of one defined type to a franking head which is also defined. Naturally, the invention is equally applicable to a franking machine which is made up differently. More generally, the transport device of the invention may be applied in any situation where it is necessary to convey objects in the form of segments of strip while causing said objects to rotate about the travel axis through an angle of up to at least 90°. The invention is applicable to angles of rotation other than 90°. This can be done by selecting different values for the cylindrical arcs.

I claim:

1. A transport device for transporting objects in the form of strip segments along their axis while causing said strips to rotate through an angle of at least 90° about the axis, said device comprising two walls disposed parallel to each other, means for holding said walls spaced apart from each other in such a manner as to allow the objects to be transported to pass therebetween, said walls being twisted together about their longitudinal axes so that the slot between them at one of the ends of said walls is oriented in a direction rotated at least 90° relative to the direction of the slot at the other end of said walls, said walls being in the form of a twisted flat strip whose width is not less than the width of the objects to be transported, and wherein each of said walls comprises between one wall and in the other wall end, successive juxtaposed portions having the following shapes respectively:

a first rectangular trapezium;
a first end parallelogram;
a first common trapezium;
a middle parallelogram;
a second common trapezium;
a second end parallelogram; and
a second rectangular trapezium;

with the desired twist being obtained with the trapeziums being flat, with the end parallelograms being curved as portions of cylindrical surfaces and in the same direction about the original plane surface, and with the middle parallelogram being curved in the opposite direction to also form a portion of a cylindrical surface.

2. A transport device according to claim 1, wherein openings are provided in at least one wall for the purposes, in particular, of inserting drive wheels and for facilitating unjamming of the transport device.

3. A transport device according to claim 2, wherein, in the direction of object displacement within the device, a second transverse edge of at least one of said openings is generally concave in shape in order to avoid the risk of jamming.

4. A transport device according to claim 2, wherein, in the direction of object displacement within the device, a second transverse edge of at least one of said openings slopes at an oblique angle in order to avoid the risk of jamming.

* * * * *